US006834984B2

(12) United States Patent
Tausch et al.

(10) Patent No.: US 6,834,984 B2
(45) Date of Patent: Dec. 28, 2004

(54) CURVED REFLECTIVE SURFACE FOR REDIRECTING LIGHT TO BYPASS A LIGHT SOURCE COUPLED WITH A HOT MIRROR

(75) Inventors: Mark Tausch, West Chester, OH (US); Charles Alexander, Cincinnati, OH (US)

(73) Assignee: Delaware Captial Formation, Inc., Wilmington, DE (US)

( * ) Notice: Subject to any disclaimer, the term of this patent is extended or adjusted under 35 U.S.C. 154(b) by 13 days.

(21) Appl. No.: 10/284,488

(22) Filed: Oct. 31, 2002

(65) Prior Publication Data

US 2004/0070977 A1 Apr. 15, 2004

Related U.S. Application Data

(60) Provisional application No. 60/418,193, filed on Oct. 15, 2002.

(51) Int. Cl.[7] ..... F21V 7/00

(52) U.S. Cl. ..... 362/346; 362/293; 362/304; 362/305; 362/343; 250/503.1

(58) Field of Search ..... 362/293, 345, 362/304, 305, 343, 346; 250/503.1

(56) References Cited

U.S. PATENT DOCUMENTS

| | | | | |
|---|---|---|---|---|
| 3,060,310 A | | 10/1962 | Bertsche, Jr. et al. | |
| 3,122,405 A | | 2/1964 | Pistey | |
| 3,263,201 A | | 7/1966 | Pistey | |
| 3,329,924 A | | 7/1967 | Henshaw, Jr. | |
| 3,727,040 A | | 4/1973 | Armstrong et al. | |
| 3,783,261 A | | 1/1974 | Hartmann | |
| 3,865,106 A | | 2/1975 | Palush | |
| 3,900,727 A | | 8/1975 | Hutz | |
| 4,149,086 A | | 4/1979 | Nath | |
| 4,422,100 A | | 12/1983 | DuVall et al. | |
| 4,563,589 A | * | 1/1986 | Scheffer | 250/504 R |

(List continued on next page.)

FOREIGN PATENT DOCUMENTS

| | | |
|---|---|---|
| JP | 4-295801 | 10/1992 |
| JP | 11-97732 | 4/1999 |
| JP | 2001-296607 | 10/2001 |

OTHER PUBLICATIONS

Dichroic filters, dichroic mirrors, dichroic cross prisms, Optical Coatings Japan, Oct. 3, 2002.

Mark Andy—News Releases, Markandy Changing the way the world goes to press, Oct. 3, 2002.

Ronkese, B. J.; "Metal Wool and Indium Heat Sink," Aug. 1978, IBM Technical Disclosure Bulletin, vol. 21, No. 3, pp. 1143–1144.

*Primary Examiner*—John Anthony Ward
*Assistant Examiner*—Jacob Y. Choi
(74) *Attorney, Agent, or Firm*—Foley & Lardner LLP

(57) ABSTRACT

A UV curing lamp is provided which includes a curved and reflective surface which may be a cold mirror and may redirect incident UV light toward a band-pass filter. The UV light may be reflected by the curved, reflective surface and transmitted through the band-pass filter whereas the IR and visible light may pass through the curved, reflective surface. The UV, IR, and visible light reflected by shutters and direct UV, IR, and visible light from the lamp are separated by the band-pass filter which transmits the UV light and reflects the IR and visible light.

21 Claims, 4 Drawing Sheets

U.S. PATENT DOCUMENTS 4,604,680 A * 8/1986 Levin et al. ..... 362/293
4,644,899 A 2/1987 Glaus
5,216,820 A * 6/1993 Green et al. ..... 34/273
5,394,317 A * 2/1995 Grenga et al. ..... 362/347
5,414,601 A * 5/1995 Davenport et al. ..... 362/538
5,440,137 A * 8/1995 Sowers ..... 250/504 R
5,552,927 A 9/1996 Wheatly et al.
5,723,937 A 3/1998 Whitman et al.
5,825,041 A * 10/1998 Belek et al. ..... 250/504 R
5,932,886 A 8/1999 Arai et al.
6,124,600 A 9/2000 Moroishi et al.
6,200,005 B1 3/2001 Roberts et al.
6,572,370 B1 6/2003 Hampden
6,621,087 B1 9/2003 Bisges et al.
6,646,278 B1 * 11/2003 Schwarz et al. ..... 250/504 R
6,719,444 B1 * 4/2004 Alber et al. ..... 362/518
6,720,566 B2 * 4/2004 Blandford ..... 250/504 R

* cited by examiner

AIR
30
50
8
20
22
52
AIR
50
100
13
13
40
40
AIR
AIR
12
12
14
14
26
24
16

CURVED REFLECTIVE SURFACE FOR REDIRECTING LIGHT TO BYPASS A LIGHT SOURCE COUPLED WITH A HOT MIRROR

CROSS-REFERENCE TO RELATED APPLICATIONS

This application claims priority to U.S. Provisional Patent Application Ser. No. 60/418,193, filed on Oct. 15, 2002, the contents of which are hereby incorporated by reference. In addition, this application incorporates by reference U.S. patent application Ser. Nos. 10/284,473 and 10/284,489 being filed concurrently herewith.

BACKGROUND OF THE INVENTION

1. Field of the Invention

The present invention relates to lamps and the heat absorption and transfer properties associated therewith. More particularly, the invention relates in one embodiment to improving the content of light usable in ultraviolet ("UV") light curing applications along with improving the capture of unusable light and dissipating the heat associated therewith.

2. Description of the Related Art

The purpose of reflective surfaces in a UV curing system is to gather and direct the light emitted from a lamp (also referred to as a "light source") directly to a two dimensional or three dimensional plane(s) or object(s) where UV curing will take place. In general, the mechanical structure that holds these reflective surfaces and the light source is called a housing. Some reflective surfaces discussed in detail herein are, in actuality, band-pass filters. These band-pass filters transmit certain wavelengths of light and reflect other wavelengths of light. Other reflective surfaces, referred to as "reflectors" reflect substantially all light incident thereon.

The light emitted from the light source is composed of three main regions of the electromagnetic spectrum: (a) wavelengths from about 200 nm to about 400 nm are generally considered to fall within the UV portion of the spectrum; (b) wavelengths from about 400 nm to about 760 nm are generally consider to fall within the visible part of the spectrum; and (c) wavelengths from about 760 nm to about 3,000 nm are generally considered to fall within the near infrared ("IR") portion of the spectrum.

In conventional housings, the light is reflected by a planar reflector or mirror 16, as shown in FIG. 1. Inherent in this reflector design is the gathering and redirecting of a part of the IR portion of the spectrum back across the surface of the lamp. This reflected IR light has been shown to cause unwanted radiant heat transfer back into the exterior and interior of the lamp. This additional heat can: (a) impair the efficient functioning of the lamp; (b) increase the operating temperature of the lamp; and (c) reduce the UV light output of the lamp.

One way to reduce the possibility of directing IR light back into the lamp is to remove the mirror 16 behind the lamp and to remove other reflective surfaces therearound that would otherwise redirect the IR light back into the lamp. However, as the mirror 16 and reflective surfaces redirect not only IR light but also UV and visible light, removing them to reduce the redirection of IR light would reduce the amount of UV light available in a UV curing application and decrease the overall efficiency of the system.

After the light is redirected in a second direction, it joins other light which originated on that second direction from the lamp; this combination of light must be separated into useable and unusable wavelengths. One way to separate the light is by using an optical filter such as a band-pass filter which may, for example, separate UV light from other types of light (e.g., IR and visible light) so that the UV light can be used in applications which depend on UV light (and which may be hampered by other types of light), such as UV curing applications.

Thus, the purpose of a band-pass filter in an optical system is to reflect light in a specific range of wavelengths and to transmit light of a different set of wavelengths. A particular type of band-pass filter, often referred to as a "cold mirror," is used to provide good reflection of light having wavelengths in a particular range and to transmit light outside of that range. For example, one type of cold mirror reflects light having wavelengths between about 200 nm and about 450 nm (i.e., UV light and the lower end of the visible light spectrum) and transmits light having wavelengths above about 450 nm, i.e., light which includes most visible light and IR light.

Band-pass filters may be used to separate light into usable and unusable light. For example, a cold mirror may be used to separate light into UV light and visible/IR light. The UV light may be reflected toward a material, such as a web, that is to be cured via a curing application. By way of contrast, the visible/IR light may be transmitted through the cold mirror (i.e., it is not directed toward the curing application at hand), to prevent unnecessary and unwanted heating of the materials that are to be cured. A prior art embodiment incorporating a band-pass filter will be described with respect to FIG. 1.

FIG. 1 is a schematic view of a prior art lamp housing 100. The lamp housing 100 contains a lamp 26 (also called a "light source 26") which projects diverging light having a variety of wavelengths from the interior 24 of the lamp 26. Some of the light is directed toward a reflective mirror 16 which reflects the light toward a band-pass filter 20, which may be a cold mirror. In some prior art embodiments, the mirror 16 is planar (as shown) whereas in other prior art embodiments the mirror 16 is curved. However, in all prior art embodiments, at least some of the light reflected by the mirror 16 is redirected back toward the light source 26.

Some of the light from the light source 26 is also reflected off shutters 12 toward the band-pass filter 20. The shutters 12, which rotate on axes 14, have inside surfaces (i.e., on the side facing the light source) which are highly polished. As a result, when an object 8 (which may be in the form of a tape or label) to be cured is moved across a window 22 in the housing 100, the shutters 12 may be opened and the polished surface of the shutters 12 used to gather and direct the light toward the band-pass filter 20.

The shutters 12 may be opened due to their being adapted to rotate on the axes 14. In a first position (not shown), the distal ends 13 of the shutters 12 approach each other, thereby substantially containing the light emitted by light source 26. In a second position, shown in FIG. 1, the distal ends 13 of the shutters 12 are separated so that the light emitted by the light source 26 can be reflected toward the band-pass filter 20.

The shutters 12 also serve a heat containment function. The temperature of the light source 26 may reach from about 650° C. to about 850° C. In some embodiments, as the light source 26 is reasonably close to the moving object 8, if the object 8 is stopped while the lamp housing 100 is emitting light, it may be preferable to protect the object 8 from the heat associated with the light emitted by light source 26 by closing the shutters 12.

The band-pass filter 20 is adapted to reflect light having a wavelength which falls within a specified range and to transmit light having wavelengths outside of that range. For example, in UV curing applications, if a cold mirror is used for the band-pass filter 20, it may reflect light having wavelengths between about 200 nm and about 450 nm (i.e., UV light coupled with the lower end of the visible light spectrum) and transmit light outside of this range including the remainder of the visible light and IR light. The light which is reflected by the cold mirror passes through a protective window 22 and may be used in applications calling for a particular type of light, e.g., UV light.

As the remaining light (e.g. visible/IR) is transmitted through the band-pass filter 20, it may be necessary to protect people and/or items which may be harmed by exposure to this light. To address this concern, the light which is transmitted through the band-pass filter 20 may pass through an air corridor 52 and into a solid heat sink 30 where it may be absorbed and converted into heat energy via radiant heat transfer.

Air, which is fed into the air corridor 52 via inlets 50, may be used to cool the heat sink 30. Similarly, air may be fed into the housing 100 via inlets 40. The air passing through the inlets 40 may be used to cool the light source 26, the mirror 16, and the shutters 12. Further, the heat sink 30 may be designed so that its shape and cross-sectional area will allow the heat absorbed therein to be transferred to a stream of cooling air in the air corridor 52 via forced/induced convection. Unfortunately, the heat sinks currently used tend to be large, expensive, and inefficient. Thus, although a solution, in the form of a heat sink apparatus, currently exists to absorb visible and infrared light transmitted through a band-pass filter, the solution is imperfect due to the size and cost of the heat sink apparatus.

In light of the aforementioned, it is desired to achieve one or more of the following in a new apparatus and method: (a) effectively redirect light without unnecessarily heating of the lamp; and/or (b) effectively absorb visible/IR light.

SUMMARY OF THE INVENTION

The invention herein contains multiple embodiments including a curing lamp which includes a light source, a reflective surface positioned behind the light source, and a band-pass filter. The reflective surface is adapted to reflect light having wavelengths in a first range so that the light does not travel back to the light source. Further, the reflective surface is adapted to transmit light having wavelengths in a second range. The band-pass filter is positioned in the path of at least some of the light which the light source is adapted to radiate and is positioned in the path of at least some of the light which the reflective surface reflects.

In another embodiment of the curing lamp, the reflective surface may be a band-pass filter.

In another embodiment of the curing lamp, the reflective surface may be a band-pass filter in the form of a cold mirror.

In another embodiment of the curing lamp, the reflective surface may be formed of two parts.

In another embodiment of the curing lamp, the reflective surface may be formed of two parts, wherein at least one of the two parts of the reflective surface may be a band-pass filter.

In another embodiment of the curing lamp, the reflective surface may be formed of two parts, wherein at least one of the two parts of the reflective surface may be a cold mirror.

In another embodiment of the curing lamp, the band-pass filter may be a hot mirror.

In another embodiment of the curing lamp, the reflective surface may be nonmetallic.

In another embodiment of the curing lamp, the reflective surface may be coated.

In another embodiment of the curing lamp, the reflective surface may be coated and polished.

In another embodiment of the curing lamp, the lamp may further include a protective window provided proximate the band-pass filter.

In another embodiment of the curing lamp, the reflective surface may be adapted to transmit visible and IR light and reflect UV light.

In another embodiment of the curing lamp, the reflective surface may be adapted to transmit visible and IR light and reflect UV light and the band-pass filter may be adapted to transmit UV light.

In another embodiment of the curing lamp, the band-pass filter may be a hot mirror, wherein the reflective surface may be adapted to transmit visible and IR light and reflect UV light, and wherein the hot mirror may be adapted to transmit UV light.

The invention also contemplates a curing lamp including a light source, a reflective surface positioned behind the light source, and a hot mirror. The reflective surface is adapted to reflect light so that the light does not travel back to the light source. The hot mirror is positioned in the path of at least some of the light which the light source is adapted to radiate and positioned in the path of at least some of the light which the reflective surface reflects.

In another embodiment of the curing lamp comprising a hot mirror, the reflective surface may be a reflector.

In another embodiment of the curing lamp comprising a hot mirror, the reflective surface may be formed of two parts.

In another embodiment of the curing lamp comprising a hot mirror, the reflective surface may be formed of two parts and at least one of the two parts of the reflective surface may be a reflector.

In another embodiment of the curing lamp comprising a hot mirror, the reflective surface may be metallic.

In another embodiment of the curing lamp comprising a hot mirror, the reflective surface may be coated.

In another embodiment of the curing lamp comprising a hot mirror, the reflective surface may be coated and polished.

In another embodiment of the curing lamp comprising a hot mirror, a protective window may be provided proximate the hot mirror.

In another embodiment of the curing lamp comprising a hot mirror, the hot mirror may be adapted to transmit UV light.

These and other features, aspects, and advantages of the present invention will become more apparent from the following description, appended claims, and accompanying exemplary embodiments shown in the drawings.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION

Figure 1:
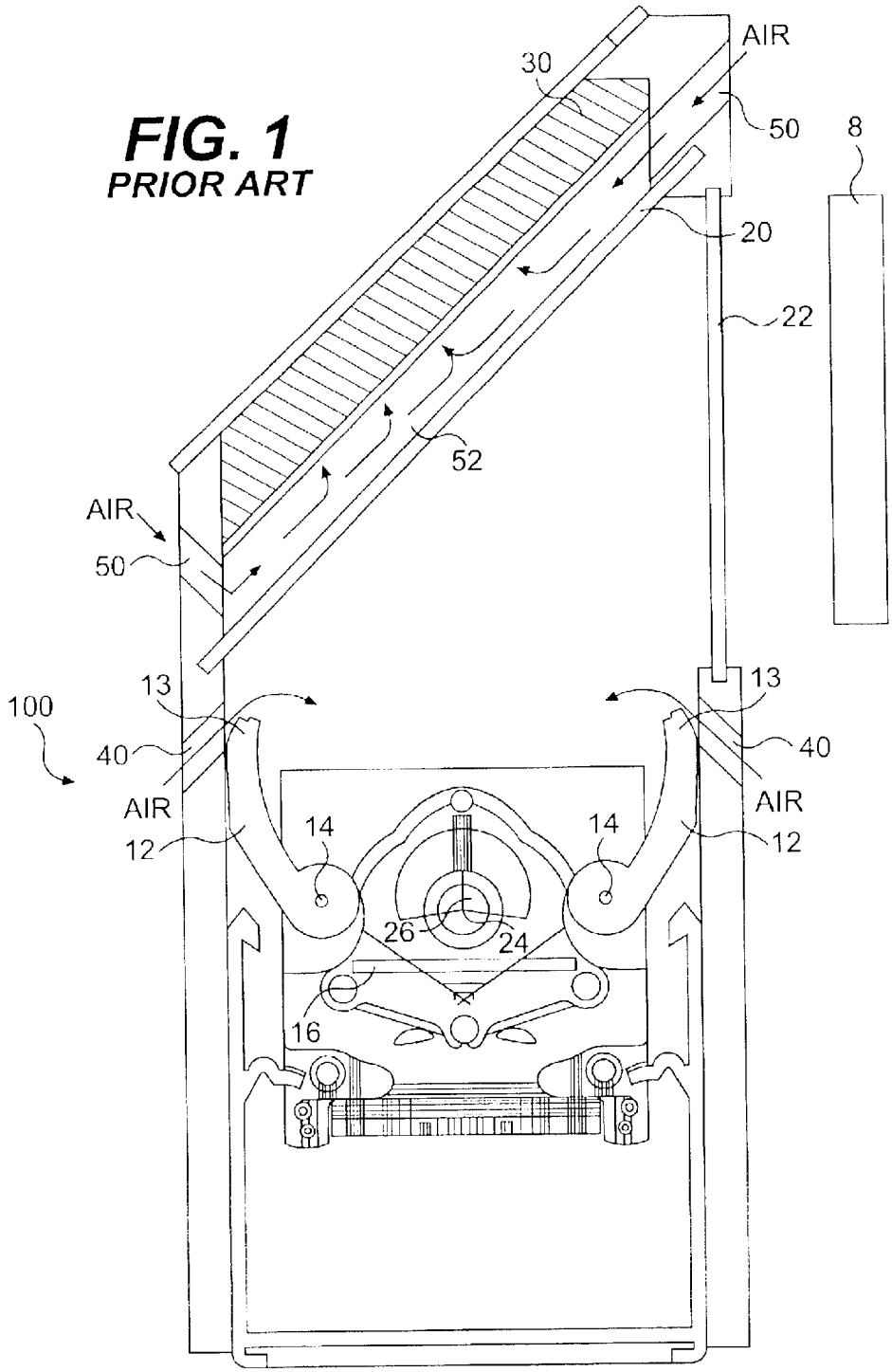
FIG. 1 PRIOR ART
FIG. 1 is a schematic view of a prior art lamp housing.

Reference will now be made in detail to embodiments of the invention, which are illustrated in the drawings. An effort has been made to use the same reference numbers throughout the drawings to refer to the same or like parts.

Figure 2:
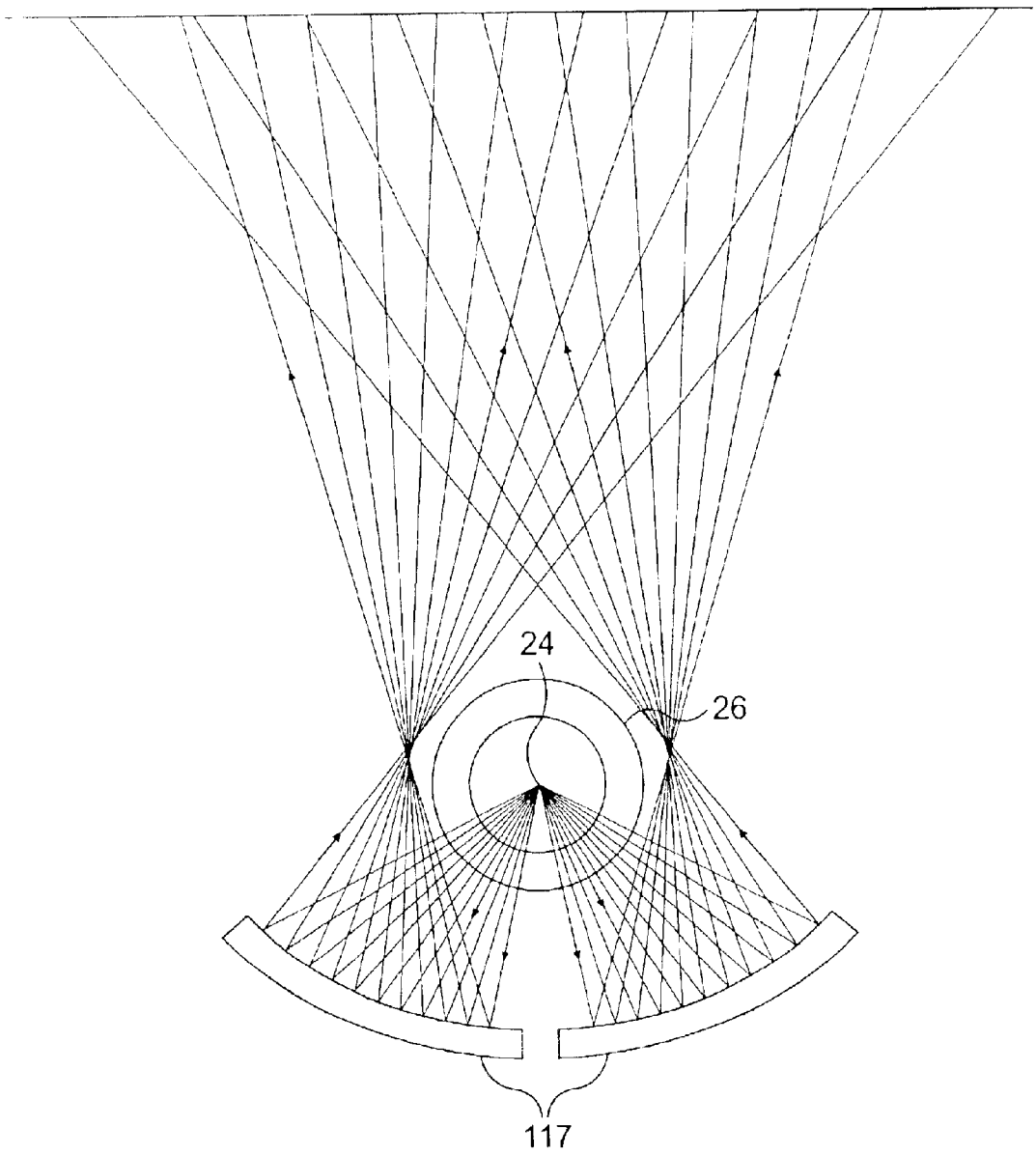
FIG. 2 is a schematic view of a two-part, curved, reflective surface, which may be a reflector or a cold mirror, which redirects incident light back toward an originating light source but in such a manner so that the redirected light is not incident on the light source.

FIG. 2 shows a curved and reflective surface 117 which is preferably in two-parts, as shown. The geometric shape of the reflective surface 117 can be made to redirect light in many different patterns including, but not limited to, a focused pattern, a collimated pattern, and a diverging pattern. As shown in FIG. 2, the reflective surface 117 is shaped to ensure that the redirected light is not directed toward the light source 26.

The reflective surface 117 may be fabricated from metallic or nonmetallic materials which may be, for example, extruded, machined, formed, cast, drawn, or molded. In addition, the reflectors may be created from a substrate material which is subjected to any number of finishing methods including, but not limited to, polishing, coating, and plating. Further, the shape of each of the parts of the reflective surface 117 can be, but is not limited to, spherical, cylindrical, aspheric, and a series of flats (i.e., a series of short, planar surfaces jointed together to form a curved surface).

The curved surfaces 117 may be designed using a method called "optical ray tracing" performed using computer aided design ("CAD") which traces each light ray. This method describes reflection and refraction of light when the light contacts a material such as an optical surface. In addition, one or both of the parts of the reflective surface 117 may be a reflector or a band-pass filter. For example, either or both of the parts of the reflective surface 117 may be a cold mirror such as that of the type previously described.

One embodiment of the invention may combine a two-part, curved, reflective surface 117 (of the type shown in FIG. 2) with band-pass filter 120, which may be a hot mirror. In this embodiment, the curved, reflective surface 117, which may be a reflector but may in some embodiments be a cold mirror, is provided behind the light source 26. Like the embodiment shown in FIG. 2, reflective surface 117 is preferably formed of two parts and may be adapted to reflect incident UV light back toward the light source 26 while bypassing the light source 26. The two-part, curved, reflective surface 117 may also be adapted to transmit other forms of light such as IR light and/or visible light, as shown.

Positioned in front of the light source 26 is a band-pass filter 120 which may be a hot mirror; the purpose of the band-pass filter 120, is to separate light useful into useable and unusable portions, such as for UV curing. A hot mirror is a type of band-pass filter which generally reflects light having wavelengths from about 400 nm to about 3,000 nm (i.e., visible and IR light) and transmits light having wavelengths from about 200 nm to about 400 nm (i.e., UV light). Whereas cold mirrors transmit IR and visible light and reflect UV light, the hot mirror 120 does substantially the opposite, i.e., it reflects IR and visible light and transmits UV light.

The band-pass filter 120 may be fabricated from nonmetallic materials which are, for example, extruded, machined, formed, cast, drawn, or molded. Further, the band-pass filter 120 may be created from a substrate material which is subjected to any number of finishing methods including, but not limited to, polishing, coating, plating, electroplating. In addition, the shape of the band-pass filter 120 may be, for example, cylindrical, aspheric, flat, or a series of flats.

In one embodiment, the two-part, curved, reflective surface 117 is a band-pass filter of the cold mirror type so that the light from the light source 26 which is incident on the two-part, curved, reflective surface 117 is separated such that substantially only UV light is reflected toward the band-pass filter 120 and subsequently passes therethrough. By way of contrast, light emitted by the light source 26 which is not incident on the two-part, curved, reflective surface 117 but which is incident on the band-pass filter 120 is separated by the band-pass filter 120; substantially all of the UV light is transmitted by the band-pass filter 120 whereas substantially all of the visible and IR light are reflected by the band-pass filter 120.

The UV light which is transmitted through the band-pass filter 120 passes through a protective window 122 which may be similar to the previously discussed protective window 22. The protective window 122 is preferably made of materials which transmit UV light and is preferably positioned proximate to the band-pass filter 120 without being in contact therewith.

The protective window 122 may be fabricated from nonmetallic materials which are, for example, extruded, machined, formed, cast, drawn, or molded. Further, the protective window 122 may be created from a substrate material which is subjected to any number of finishing methods including, but not limited to, polishing, coating, plating, electroplating. In addition, the shape of the protective window 122 may be, for example, cylindrical, aspheric, flat, or a series of flats.

Figure 3:
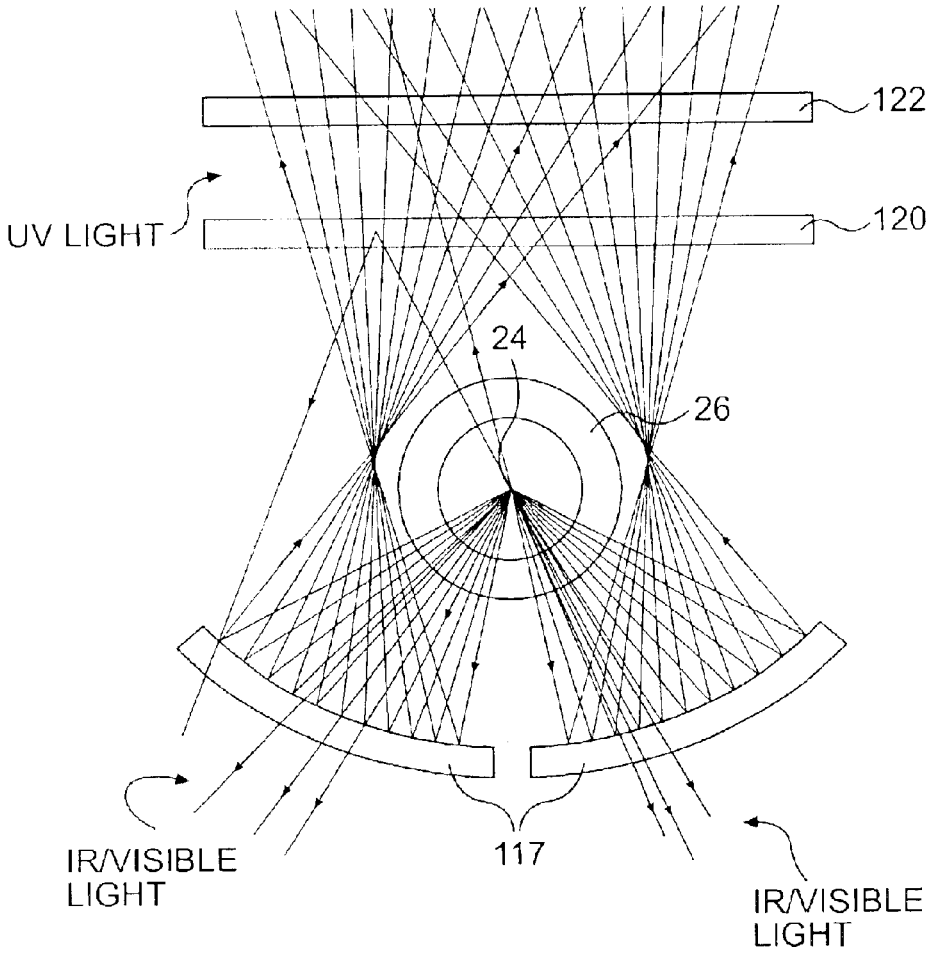
FIG. 3 is a schematic view of a two-part, curved, reflective surface, which may be a reflector or a cold mirror, which may redirect incident UV light back toward a hot mirror and toward an originating light source but in such a manner so that the redirected UV light is not incident on the light source, and which may transmit other forms of light such as IR light and/or visible light.
Figure 4:
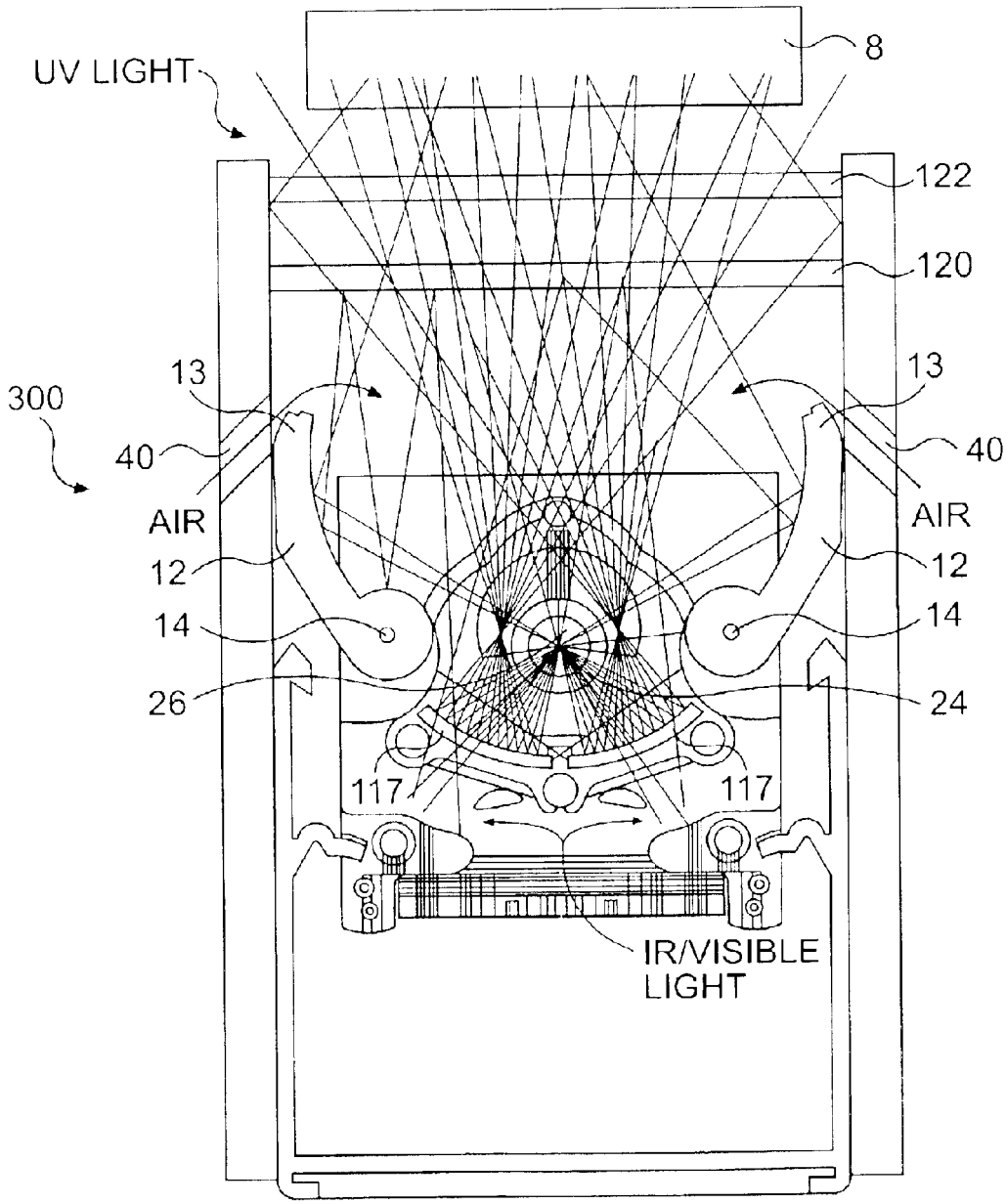
FIG. 4 is a schematic view of an alternate embodiment housing in which the two-part, curved, reflective surface of FIG. 3 is provided behind the light source and in which a band-pass filter, which may be a hot mirror, is provided between the light source and an object to be cured.

The embodiment shown in FIG. 3 may be incorporated into an alternate embodiment housing 300, as shown in FIG. 4. The UV light which is transmitted through the protective window 122 is available for applications such as UV curing an object 8. Further, as the housing 300 substantially prevents the IR and visible light from being transmitted through the band-pass filter 120 and the protective window 122, unnecessary heating of the object 8 can be inhibited.

In operation, the shutters 12 will be moved to the open position in which the distal ends 13 of the shutters are away from each other. The light source 26 will be activated to radiate light energy. Some of the light will reflect off of the two-part, curved, reflective surface 117 and off of the shutters 12 toward band-pass filter 120 whereas some of the light will travel directly from the light source 26 to the band-pass filter 120.

If the two-part, curved reflective surface 117 is a band-pass filter such as a cold mirror, light having wavelengths in a specified range (e.g., about 200 nm to about 450 nm) will be reflected by the curved, reflective surface 117 and will pass through the band-pass filter 120 and the protective window 122, whereas the remainder of the light (i.e., light having wavelengths which do not fall within the specified range) will be transmitted through the curved reflective surface 117 back into the lamp housing 300. In other words, the UV light reflected by the curved, reflective surface 117 will be transmitted through the band-pass filter 120 whereas substantially all of the IR and visible light will pass through the curved, reflective surface 117.

The UV, IR, and visible light reflected by shutters 12 and direct UV, IR, and visible light from the lamp 26 will be separated by the band-pass filter 120. The UV will be transmitted through the band-pass filter 120 whereas the IR and visible light will be reflected by the band-pass filter 120.

Unlike the prior art embodiment, the embodiment in FIG. 4 does not include a heat sink. To protect a user and/or an object 8 from the heat dissipated by the visible and IR light in the housing 300, the heat is substantially maintained in the housing 300. Further, to prevent an undesirable heating of the light source 26, air may be fed into the housing 300 via inlets 40. The air passing through the inlets 40 may be used to cool the light source 26, the curved, reflective surface 117, the shutters 12, and/or the hot mirror 120.

Although the aforementioned describes embodiments of the invention, the invention is not so restricted. It will be apparent to those skilled in the art that various modifications and variations can be made to the disclosed preferred embodiments of the present invention without departing from the scope or spirit of the invention.

In addition to the aforementioned modifications, the invention is not limited to the field of lamps. Accordingly, it should be understood that the apparatuses described herein are illustrative only and are not limiting upon the scope of the invention, which is indicated by the following claims.

What is claimed is:

1. A curing lamp comprising:

a light source;

a reflective surface positioned behind the light source, wherein the reflective surface is designed to reflect light having wavelengths in a first range so that substantially no reflected light is incident on the light source, and wherein the reflective surface is designed to transmit light having wavelengths in a second range; and a band-pass filter positioned in the path of at least some of the light which the light source is designed to radiate and positioned in the path of at least some of the light which the reflective surface reflects, wherein the reflective surface is formed of two parts.

2. The curing lamp according to claim 1, wherein the reflective surface is a band-pass filter.

3. The curing lamp according to claim 2, wherein the reflective surface is a cold mirror.

4. The curing lamp according to claim 1, wherein at least one of the two parts of the reflective surface is a band-pass filter.

5. The curing lamp according to claim 1, wherein at least one of the two parts of the reflective surface is a cold mirror.

6. The curing lamp according to claim 1, wherein the band-pass filter is a hot mirror.

7. The curing lamp according to claim 1, wherein the reflective surface is nonmetallic.

8. The curing lamp according to claim 1, wherein the reflective surface is coated.

9. The curing lamp according to claim 8, wherein the reflective surface is polished.

10. The curing lamp according to claim 1, further comprising: a protective window provided proximate the band-pass filter.

11. The curing lamp according to claim 1, wherein the reflective surface is designed to transmit visible and IR light and reflect UV light.

12. The curing lamp according to claim 11, wherein the band-pass filter is designed to transmit UV light.

13. The curing lamp according to claim 6, wherein the reflective surface is designed to transmit visible and IR light and reflect UV light, and wherein the hot mirror is designed to transmit UV light.

14. A curing lamp comprising:

a light source;

a reflective surface positioned behind the light source and designed to reflect light so that substantially no reflected light is incident on the light source; and a hot mirror positioned in the path of at least some of the light which the light source is designed to radiate and positioned in the path of at least some of the light which the reflective surface reflects, wherein the reflective surface is formed of two parts.

15. The curing lamp according to claim 14, wherein the reflective surface is a reflector.

16. The curing lamp according to claim 14, wherein at least one of the two parts of the reflective surface is a reflector.

17. The curing lamp according to claim 14, wherein the reflective surface is metallic.

18. The curing lamp according to claim 14, wherein the reflective surface is coated.

19. The curing lamp according to claim 18, wherein the reflective surface is polished.

20. The curing lamp according to claim 14, further comprising: a protective window provided proximate the hot mirror.

21. The curing lamp according to claim 14, wherein the hot mirror is designed to transmit UV light.

* * * * *